US009362697B2

(12) United States Patent
Lewis et al.

(10) Patent No.: US 9,362,697 B2
(45) Date of Patent: Jun. 7, 2016

(54) FIBER-ON-TIP CONTACT DESIGN BRUSH ASSEMBLIES

(75) Inventors: Norris E. Lewis, Christiansburg, VA (US); Jerry T. Perdue, Christiansburg, VA (US)

(73) Assignee: Moog Inc., East Aurora, NY (US)

( * ) Notice: Subject to any disclaimer, the term of this patent is extended or adjusted under 35 U.S.C. 154(b) by 407 days.

(21) Appl. No.: 14/113,632

(22) PCT Filed: Mar. 13, 2012

(86) PCT No.: PCT/US2012/000137
§ 371 (c)(1),
(2), (4) Date: Oct. 24, 2013

(87) PCT Pub. No.: WO2013/137843
PCT Pub. Date: Sep. 19, 2013

(65) Prior Publication Data
US 2014/0045348 A1 Feb. 13, 2014

(51) Int. Cl.
*H01R 39/08* (2006.01)
*H01R 39/24* (2006.01)
*H01R 39/22* (2006.01)

(52) U.S. Cl.
CPC ..... *H01R 39/24* (2013.01); *H01R 39/22* (2013.01)

(58) Field of Classification Search
None
See application file for complete search history.

(56) References Cited

U.S. PATENT DOCUMENTS 4,358,699 A * 11/1982 Wilsdorf ..... H01R 39/24 310/251
4,415,635 A * 11/1983 Wilsdorf ..... H01R 39/24 310/248
5,250,756 A * 10/1993 Swift ..... H01R 13/22 174/110 R
6,245,440 B1 * 6/2001 Kuhlmann-Wilsdorf H01R 39/22 29/826
6,903,484 B1 * 6/2005 Kuhlmann-Wilsdorf ..... H01R 39/381 310/239
7,339,302 B2 * 3/2008 Lewis ..... H01R 39/381 310/232
7,495,366 B2 * 2/2009 Day ..... H01R 39/08 310/232
7,545,073 B2 * 6/2009 Lewis ..... H01R 39/24 310/232

* cited by examiner

*Primary Examiner* — Tran Nguyen
(74) *Attorney, Agent, or Firm* — Phillps Lytle LLP

(57) ABSTRACT

The present invention broadly provides improvements in a slip-ring adapted to provide electrical contact between a stator and a rotor. The improved slip-ring includes a brush assembly having a brush tube mounted on the stator and having a fiber bundle composed of a number of individual fibers. The upper marginal end portions of the fibers are received in the brush tube. The lower marginal end portions of the fibers extend beyond the brush tube toward the rotor. The improvements broadly comprise: a central portion of the fibers having been removed below the brush tube such that the fibers extending below the brush tube toward the rotor are in the form of an annulus; and wherein the tangential compliance of the fiber bundle at its point of contact with the rotor is more than twice the tangential compliance of the fiber bundle if the central portion had not been removed.

26 Claims, 15 Drawing Sheets
(14 of 15 Drawing Sheet(s) Filed in Color)

Schematic Illustration of a junction or contact between two solid bodies

The system analyzed at high sliding speeds considers a small body 1 always in contact with a large body 2. Points in body 2 only make contact periodically.

Ring Wear Analysis

Ring No. 1
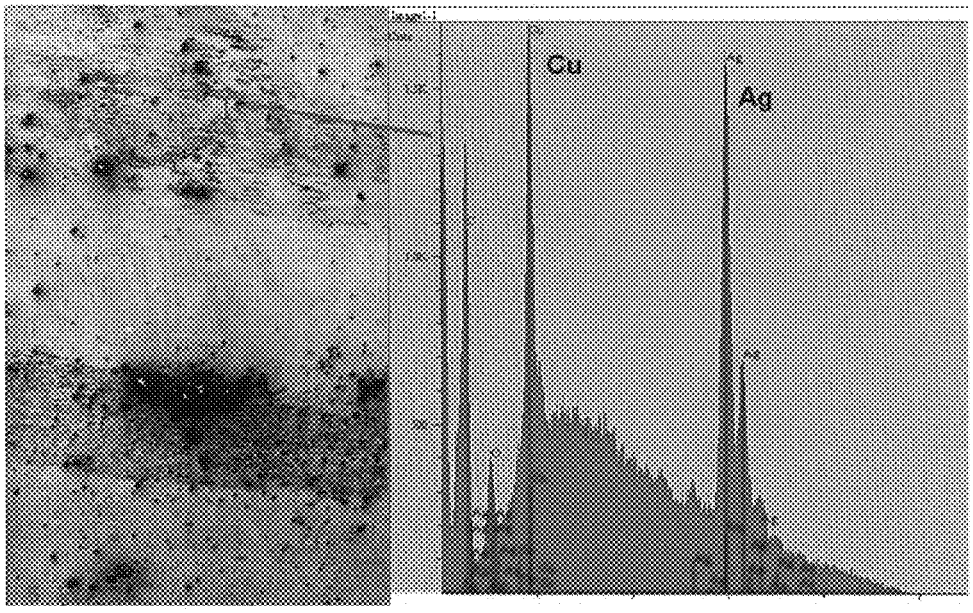
Fig. 2A
(PRIOR ART)
Fig. 2B
(PRIOR ART)
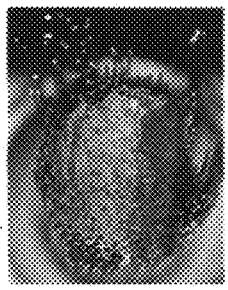
Fig. 2C
(PRIOR ART)
LEADING
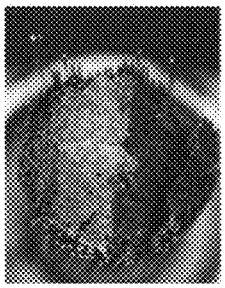
Fig. 2E
(PRIOR ART)
TRAILING
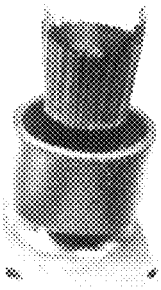
Fig. 2D
(PRIOR ART)
LEADING
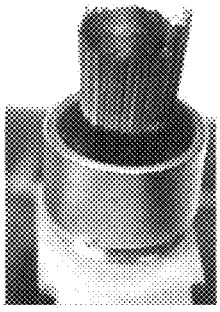
Fig. 2F
(PRIOR ART)
TRAILING Ring No. 2
Fig. 3B
(PRIOR ART)
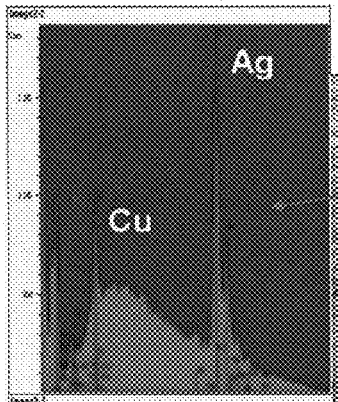
Fig. 3A
(PRIOR ART)
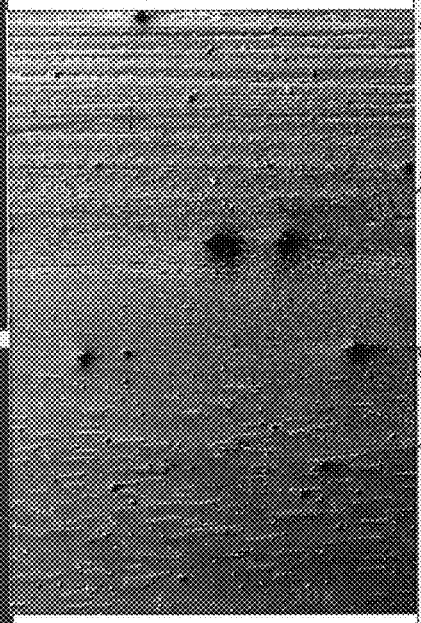
Fig. 3D
(PRIOR ART)
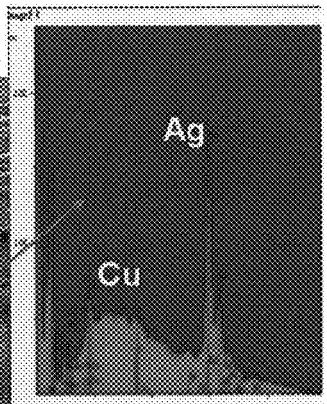
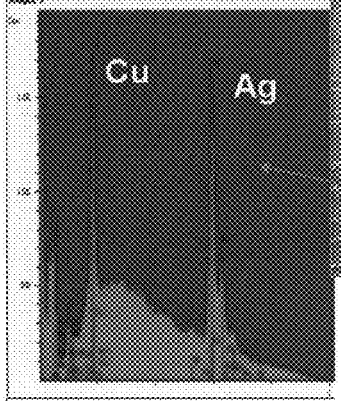
Fig. 3C
(PRIOR ART)
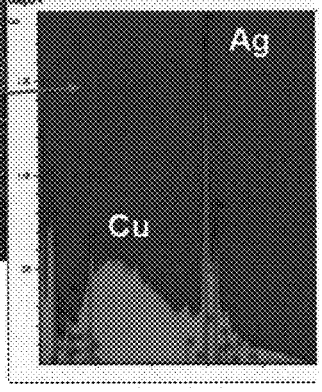
Fig. 3E
(PRIOR ART)
Ring No. 2 Leading
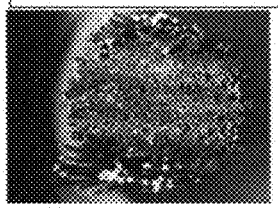
Fig. 3F
(PRIOR ART)
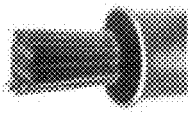
Fig. 3G
(PRIOR ART)
Ring No. 2 Trailing
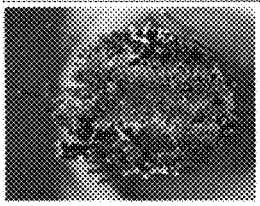
Fig. 3H
(PRIOR ART)
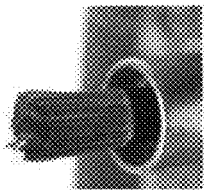
Fig. 3I
(PRIOR ART)

Fig. 9A
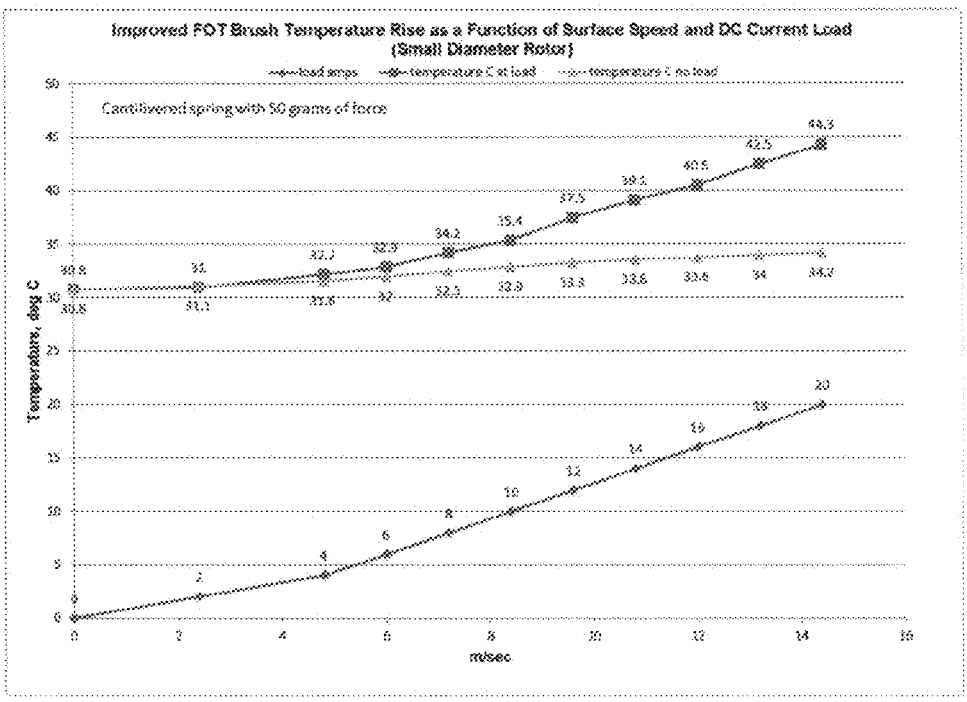
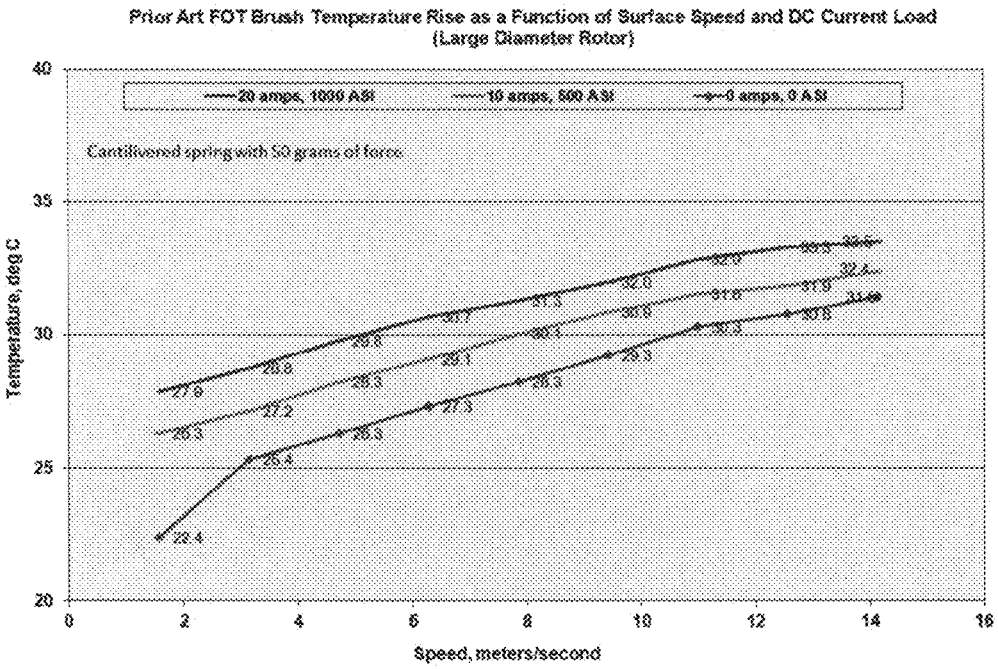
Fig. 9B

FIG. 4:7. VIBRATION OF CANTILEVER SPRING

FIBER-ON-TIP CONTACT DESIGN BRUSH ASSEMBLIES

TECHNICAL FIELD

The present invention relates generally to electrical contact technology for transmitting electrical power and/or signal(s) between a rotor and stator, and, more particularly, to improvements in electrical contact technology that enable a fiber-on-tip (FOT) brush assembly to have a longer life and less frictional heating at higher rotor surface speeds and at lower cost than with current FOT technology.

BACKGROUND ART

Various arrangements and configurations of prior art slip-rings employing FOT brush assemblies are representatively shown and described in U.S. Pat. No. 7,105,983 B2, U.S. Pat. No. 7,339,302 B2, U.S. Pat. No. 7,423,359 B2, U.S. Pat. No. 7,495,366 B2 and U.S. Pat. No. 7,545,073 B2. These prior art references are assigned to the assignee of the present application, and are hereby incorporated by reference.

Electrical contacts are used to transfer electrical power and/or signal(s) between a rotor and a stator. These devices are used in many different military and commercial applications, such as solar array drive mechanisms, aircraft and missile guidance platforms, wind energy systems, computed tomography (CT scan) systems, and the like. In some of these applications, slip-rings are used in conjunction with other components, such as torque motors, resolvers and encoders. Electrical slip-rings must be designed to be located either on the platform axis of rotation, or be designed with an open bore which locates the electrical contacts off-axis. Hence, the designations "on-axis" and "off-axis" slip-rings, respectively.

The diameters of slip-rings may range from a fraction of an inch to multiple feet, and the relative angular speed ($\omega$) between the rotor and stator may vary from one revolution per day to as much as 20,000 revolutions per minute (rpm). In all of these various applications, the electrical contacts between the rotor and stator should: (1) be able to transfer power and/or signal(s) without interruption at high relative surface speeds, (2) have long wear life, (3) have low electrical noise, and (4) be of a physical size that allows multiple circuits to be packaged in a minimum volume.

Proper management of the electrical and mechanical contact physics between the brush assembly and the rotor allows demanding requirements to be met. For example, if the application is an off-axis slip-ring that allows an x-ray tube in a CT scan gantry to rotate about the patient's body, the electrical contacts must be designed to carry about 100-200 amps (with possible surges of hundreds of amps), to operate at surface speeds on the order of 15 meters per second (m/sec), to last for 100 million revolutions, and to occupy a minimal volume within the gantry. In order to meet the 100 million revolution requirement for a device that is about six feet [1.8288 meters ("m")] in diameter, the brush force (i.e., the force with which the brush tips are urged against the rotor) must be low to minimize frictional heating and yet maintain a large number of contact points between the brush and rotor ring to achieve the required current density.

There has been a renewed interest in the use of fibrous metal brushes in recent years. Metal fiber brushes have the capability of providing higher current densities, of having lower electrical noise, and of having longer life while operating at higher surface speeds. Each of these parameters is related to more points of contact between brush and rotor ring than with composite brushes, less force per fiber, and less frictional heating. The area of contact between the fiber tips and a rotor ring is known as the "interfacial" area of contact. It is known that the actual area of contact between the face of a composite brush and a rotor is much less than its geometric area. Hence, the reason for sub-dividing brushes into elements which, in some cases, are individual small-diameter fibers.

The tribological properties of electrical contacts and the right choice of lubricant to meet the requirements of the application are extremely important. For example, if the contacts are to be used in a space application, the lubricant must not only meet all of the requirements of a ground-based application, but must also have a low vapor pressure as well. If the contacts have a long-life requirement, then dust, wear debris and other contaminants may accumulate in the contact zone and create problems with life and signal transfer.

Accordingly, it would be highly desirable to provide improved electrical contacts for transmitting electrical power and/or signal(s) between a rotor and a stator.

It would also be highly desirable to provide improved fiber brush assemblies for use in such slip-rings.

It would also be highly desirable to provide improved slip-rings that employ FOT technology, and that allow a brush assembly to have a longer life at higher rotor surface speeds and at lower cost than with current FOT technology.

DISCLOSURE OF THE INVENTION

With parenthetical reference to the corresponding parts, portions or surfaces of the disclosed embodiments, merely for purposes of illustration and not by way of limitation, the present invention broadly provides improvements in electrical contacts adapted to provide electrical contact between a stator and a rotor.

The improved slip-ring includes a brush assembly having a brush tube mounted on the stator and having a fiber bundle composed of a number of individual fibers. The first or upper marginal end portions of the fibers are received in the brush tube. The second or lower marginal end portions of the fibers extend beyond the brush tube toward the rotor.

The improvement broadly comprises: a central portion of the fibers having been removed below the brush tube such that the fibers extending below the brush tube toward the rotor are in the form of an annulus when seen in a plane transverse to the longitudinal centerline of the bundle; and wherein the tangential compliance of the fiber bundle at its point of contact with the rotor is more than twice the tangential compliance of the fiber bundle if the central portion had not been removed.

A portion of the brush tube may be crimped or swaged to hold the first or upper marginal end portions of the fibers therein.

The tangential compliance of the fiber bundle at its point of contact with the rotor may be more than 2½ times the tangential compliance of the fiber bundle if the central portion had not been removed.

The central portion may contain about half of the number of fibers in the bundle.

Thus, for example, the fiber bundle may have about 2000 individual fibers, and the central portion may account for the space occupied by about 1000 fibers.

The annulus may have a substantially-constant radial thickness when seen in a plane transverse to the longitudinal centerline of the bundle.

Each fiber may have a diameter in the range of 0.002-0.005 inches [0.0508-0.1270 millimeters ("mm")]. In one form, the fibers have a nominal diameter of about 0.003 inches [0.0762 mm].

The length of each fiber extending beyond the tube and toward the rotor may be in the range of 0.3-0.7 inches [7.62-17.78 mm]. In one embodiment, this length is about 0.40 inches [10.16 mm].

The transverse cross-sectional area of the central portion may be more than ⅔ of the transverse cross-sectional area of the fiber bundle.

The tangential compliance of the fiber bundle may be about 0.006350 inches/gram [0.16129 mm/g] at its point of contact with the rotor, whereas the tangential compliance of a fiber bundle from which the central portion had not been removed may be about 0.00139 inches/gram [0.035306 mm/g] at its point of contact with the rotor.

The tangential compliance of the fiber bundle at its point of contact with the rotor may be more than 4.5 times the tangential compliance of the fiber bundle at its point of contact with the rotor if the central portion had not been removed.

The improvement may further include a reservoir above the brush tube, the reservoir being in fluid communication with the fiber bundle, and a lubricant in the reservoir.

The reservoir may be in fluid communication with the fiber bundle through the spaces between the fibers, and the flow of lubricant through the spaces is a function of the sizes of the spaces. The flow of lubricant through the spaces will reach the interfacial area of contact and will reduce the coefficient of friction, and thus reduce the interfacial temperature.

The improvement may further include resilient means for urging the fiber bundle to move toward the rotor. The resilient means may include a negator spring and/or a cantilever spring.

The fiber bundle may be urged to move toward the rotor with substantially-constant force.

Accordingly, the general object of the invention is to provide improved slip-rings for transmitting electrical power and/or signal(s) between a rotor and a stator.

Another object is to provide improved brush assemblies for use in improved slip-rings.

Still another object is to provide improved slip-rings that employ FOT technology, and that allow a brush assembly to have a longer life at higher rotor surface speeds and at lower cost that with current FOT technology.

These and other object and advantages will become apparent from the foregoing and ongoing specification, the drawings, and the appended claims.

BRIEF DESCRIPTION OF THE DRAWINGS

The patent or application file contains at least one black-and-white or color photographic drawing, or a drawing figure containing color indicia. Copies of this patent or patent application publication with black-and-white or color photographic drawings, or with other figures containing color indicia, will be provided by the Office upon request and payment of the necessary fee.

FIG. 2A is an SEM showing the wear track of Ring 1 on a large-diameter rotor.

FIG. 2B is an EDAX analysis of the portion of the wear track indicated by the arrow in FIG. 2A, showing that silver and copper have been transferred from the brush to the rotor ring.

FIG. 2C is a photograph of a leading brush that produced the wear track shown in FIG. 2A, taken at a near-normal angle, showing the wear pattern thereon.

FIG. 2D is another photograph of the leading brush shown in FIG. 2C, albeit taken at an oblique angle.

FIG. 2E is a photograph of a trailing brush that produced the wear track shown in FIG. 2A, taken at a near-normal angle.

FIG. 2F is another photograph of the trailing brush shown in FIG. 2E, but taken at an oblique angle.

FIG. 3A is an SEM showing the wear pattern on Ring 2 of a large-diameter rotor.

FIGS. 3B-3E are EDAX analyses of the ring composition at the indicated arrows shown in FIG. 3A, showing that silver and copper have been transferred from the brush to the ring.

FIG. 3F is a photograph, taken at a near-normal angle, showing the wear pattern on a leading brush that produced the wear track shown in FIG. 3A.

FIG. 3G is a photograph, taken at an oblique angle, of the leading brush shown in FIG. 3F.

FIG. 3H is a photograph, taken at a near-normal angle, showing the wear pattern on a trailing brush that produced the wear track shown in FIG. 3A.

FIG. 3I is a photograph, taken at an oblique angle, of the trailing brush shown in FIG. 3H.

FIG. 9A is a plot of temperature (ordinate) vs. speed and current (abscissa) for an improved brush assembly loaded with 50 grams of force via a cantilevered spring, and also showing the temperature vs. speed characteristics of a loaded and an unloaded improved FOT brush assembly.

FIG. 9B is a plot of temperature (ordinate) vs. speed (abscissa) for a prior art brush assembly loaded with 50 grams of force via a cantilevered spring at three different current levels.

DESCRIPTION OF THE PREFERRED EMBODIMENTS

Figure 1A:
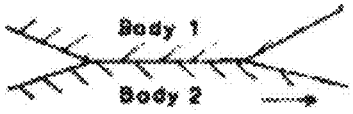
FIG. 1A is a schematic illustration of a junction or contact between two solid bodies, this being reproduced from the text quoted in the specification.

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

FOT brush designs have been developed to meet the requirements of longer life, higher surface speeds, and higher current. However, recent studies have shown that improvements can be made to existing FOT brush designs that will yield better performance under extreme conditions.

For example, consider two electrical contact systems operating at the same nominal surface speed, but having rotor diameters that differ by a factor of five. The system with the smaller-diameter rotor must have a rotational speed that is five times greater than that of the larger-diameter system in order to have the same surface speed (i.e., $V=\omega r$, where V is the surface speed, w is the angular speed of the rotor relative to the stator, and r is the radius of the rotor).

It is known that the smaller-diameter system can exhibit a phenomena known as the "rpm effect" when the contacts are being lubricated by the adsorption of adventitious films. [See, e.g., Pitney, Kenneth E.; *Ney Contact Manual: Electrical Contacts for Low Energy Uses*; Bloomfield: The J. M. Ney Company (1973) at p. 23.] Adventitious films (e.g., humidity) and airborne contaminants (e.g., hydrocarbons) are very thin films of material that are capable of reducing the coefficient of friction between contact members under light load. The "rpm effect" dictates the time available for surface changes before the next surface encounter takes place. (Id.) When a boundary lubricant is involved, the system having the larger-diameter rotor will require a larger quantity of lubricant because of the increased surface area for an equivalent number of rotor inches of travel.

Figure 1B:
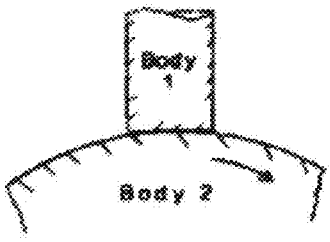
FIG. 1B is a schematic illustration that the system analyzed at high sliding speeds considers a small body always in contact with a large body, this being reproduced from the text quoted in the specification.

According to one analyst [Rabinowicz, Ernest; "The Temperature Rise at Sliding Electrical Contacts"; *Advances in Electrical Current Collection*; Ed. I. R. McNab. New York: Elsevier/North-Holland Inc.; (1982), at pp. 30 and 31], and as shown in FIGS. 1A and 1B which are reproduced from this paper, it has been shown that:

"Taking first the situation where slow speed sliding occurs and heating is caused by friction, it turns out that if there is a circular region of contact between the sliding surfaces, the average temperature rise θ is given by the relationship:

$$\theta = \frac{fLv}{4Jr(k_1 + k_2)}$$

where J is the mechanical equivalent of heat (a conversion factor from thermal to mechanical units of heat), r is the radius of the junction, f is the friction coefficient, L is the normal load at the junction, $k_1$ is the thermal conductivity of body 1, $k_2$ is the thermal conductivity of body 2 and v is the velocity.

This relationship assumes that heat originates at the interface and is then conducted into the two adjacent bodies.

The reason why the temperature rise is proportional to the velocity is because the rate of heat generation per unit of time is itself proportional to the velocity.

When the sliding becomes large this relationship is no longer applicable. Let us consider the simplest case when body 1 is a small specimen while body 2 has an extended surface. In that case the small specimen will be continually in contact and will slide always over fresh areas of the large specimen. For that case the temperature rise is given by:

$$\theta = \frac{f L v^{1/2}}{3.6 J (p_2 c_2 r^3 k_2)^{1/2}}$$

where f, L, v, r, J and $K_2$ have the same definitions as above and $p_2c_2$ is the volume specific heat of the extended surface.

This relationship differs from the previous one in two ways. First, it is unsymmetrical as regards the top and bottom surfaces because the top surface, being small and continually in contact, soon becomes hot, while the bottom surface, being always fresh, is much cooler, so essentially all the heat travels into it and thus only its thermal properties are significant.

Secondly, it will be noted that velocity to the power one-half comes into equation. This comes about because as we raise the speed we increase the rate of heating, but we also increase the amount of cool bottom material into which this heat can be dissipated. Thus, it is logical to expect that the temperature rise increases with v but less rapidly than to the first power."

It is important to reduce the coefficient of friction between sliding electrical contacts to minimize interfacial heating. This foregoing analyst noted that if the temperature at the interface becomes too great, the materials may soften or even melt, or else excessive oxidation may occur. (Id. at p. 29)

Prior Art FOT Brush Design and Analysis with Small-Diameter (i.e., 9-Inch) Rotor (FIGS. 1C-1H)

Preliminary wear studies were performed with multiple fiber-on-tip (FOT) prior art brushes in a common holder using a negator spring (i.e., a spring that exerts substantially constant force over a given range of displacement) to provide a substantially-constant normal force on a 9-inch [0.23 m] diameter ring. The contacts were not lubricated. The normal force was 135 grams, and the rotor was rotated at an angular speed of about 14.4 m/sec relative to the stator. The circular brush wore in the center, and, at the same time, some of the brush material was transferred to and adhered to the ring. This was determined from brush wear patterns and ring wear track appearance. Scanning Electron Microscope/Energy Dispersive X-ray Analysis (SEM/EDAX) confirmed that brush material had transferred to the ring.

Figures 1C, 1D, 1E:
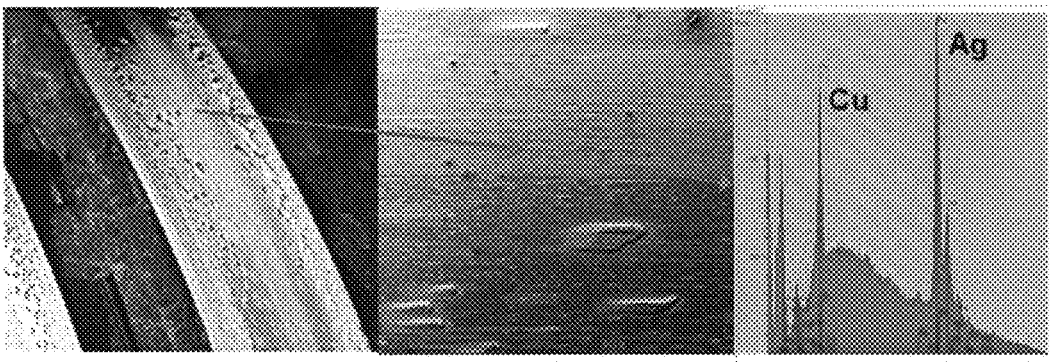
FIG. 1C is a scanning electron micrograph (SEM) of a wear track on a prior art slip-ring.
FIG. 1D is an SEM showing an enlarged view of a portion of the slip-ring wear track shown in FIG. 1C.
FIG. 1E is an energy dispersive X-ray analysis (EDAX) of the indicated spot shown in FIG. 1D, showing that silver (Ag) and copper (Cu) had been transferred from the brushes to the rotor.
Figure 1F:
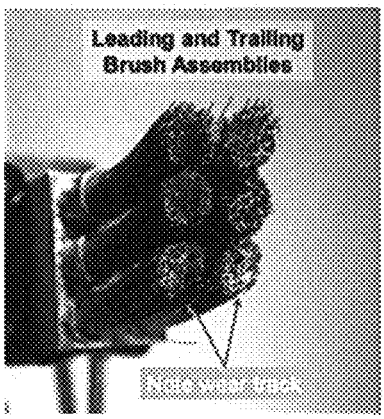
FIG. 1F is a photograph of two brush blocks (i.e., one leading and one trailing) of three fully-packed prior art brushes that produced the wear track shown in FIG. 1C.
Figures 1G, 1H:
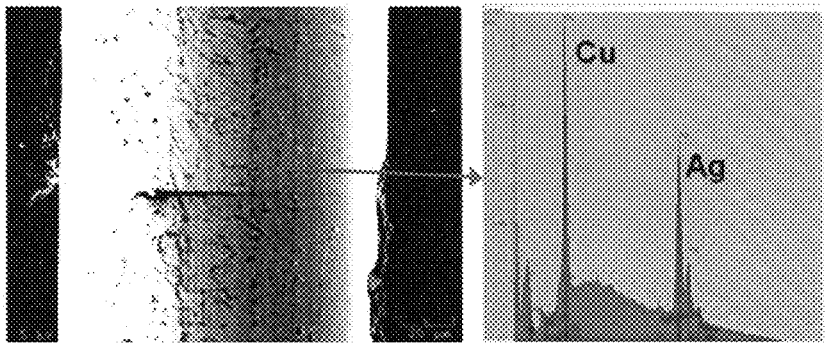
FIG. 1G is an SEM of an Ag/Cu brush.
FIG. 1H is an EDAX analysis of the indicated spot of the Ag/Cu brush shown in FIG. 1G, which has been included for reference.

FIG. 1C is an SEM of a wear track from a prior art brush on a [0.23 m] ring. FIG. 1D is an SEM showing an enlarged view of a portion of the ring shown in FIG. 1C. FIG. 1E is an EDAX analysis of the indicated spot shown in FIG. 1D, showing that silver and copper had been transferred from the brushes to the rotor. FIG. 1F is a photograph of two brush blocks (leading and trailing) of three fully-packed prior art brushes that produced the wear track shown in FIG. 1C. FIG. 1G is an SEM of an Ag/Cu fiber which has been provided as an EDAX reference for Ag/Cu brush material. FIG. 1H is an EDAX spectra for Ag/Cu brush material.

This prior art FOT configuration was developed as a replacement for a conventional metal-graphite composite brush. Three prior art FOT assemblies were positioned in a metal base of the same shape as the composite brush. The purpose of the multiple prior art FOT brushes was to provide a high current density capability at 1200 rpm. The brush wear that occurred during this test was a classic example of the statement referenced by Rabinowitz that if the interfacial temperature is too great, the materials may melt or soften, or oxidation may occur. (Id.)

Prior Art FOT and Brush Design Studies with Large-Diameter (i.e., 55-Inch) Rotor (FIGS. 2A-2I and FIGS. 3A-3I)

Additional wear studies were performed on a large-diameter ring having a diameter of approximately 55 inches [1.397 m] at a surface speed of about 14.5 m/sec. Cantilever springs were used to maintain a normal force of the brush against the rotor of about 50 grams. Lubricant was applied to brushes and rings. These studies also showed that the interfacial temperature was high enough for the brush material to soften and transfer to the ring over long periods of time.

The ring wear track appearance and brush wear patterns for the above ring (i.e., Ring 1) are shown in FIGS. 2A-2F. FIG. 2A is an SEM showing the wear track of Ring 1 on the rotor. FIG. 2B is an EDAX analysis of the portion of the wear track indicated by the arrow in FIG. 2A, showing that silver and copper have been transferred from the brush to the ring. FIG. 2C is a photograph of a leading brush, taken at a near-normal angle (i.e., looking in a direction substantially aligned with the longitudinal axis of the brush and bundle), showing the wear pattern thereon. FIG. 2D is another photograph of the leading brush shown in FIG. 2C, albeit taken at an oblique angle. FIG. 2E is a photograph of a trailing brush, taken at a near-normal angle. FIG. 2F is another photograph of the trailing brush shown in FIG. 2E, but taken at an oblique angle.

The brush wear patterns and ring wear track appearance for another ring (i.e., Ring 2) are shown in FIGS. 3A-3I. FIG. 3A is an SEM showing the wear pattern on Ring 2 of the rotor. FIGS. 3B-3E are EDAX analyses of the ring composition at the indicated arrows shown in FIG. 3A, showing that silver and copper have been transferred from the brush to the ring. FIG. 3F is a photograph, taken at a near-normal angle, showing the wear pattern on the leading brush. FIG. 3G is a photograph, taken at an oblique angle, of the leading brush shown in FIG. 3F. FIG. 3H is a photograph, taken at a near-normal angle, showing the wear pattern on a trailing brush. FIG. 3I is a photograph, taken at an oblique angle, of the trailing brush shown in FIG. 3H.

Figure 4:
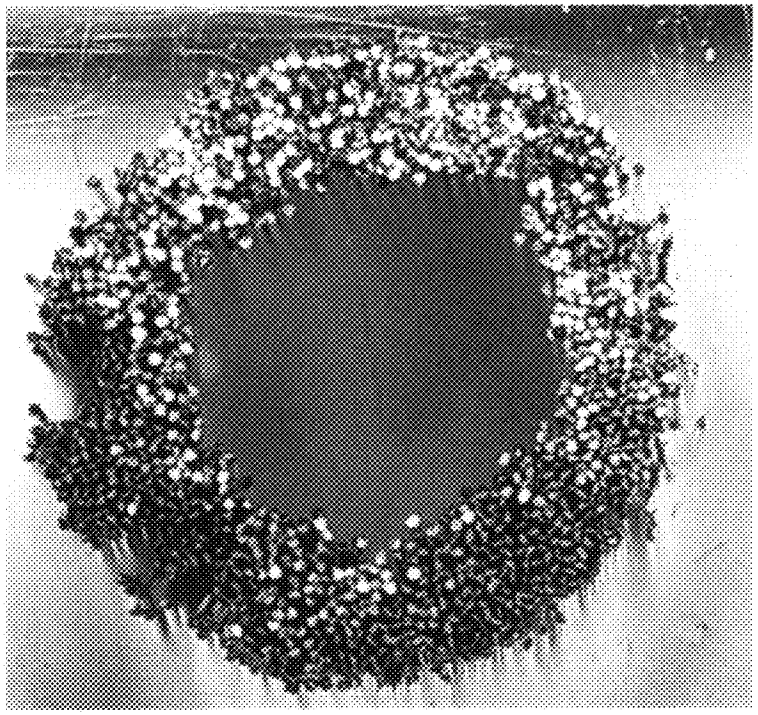
FIG. 4 is a photograph of an end of an improved FOT brush assembly having an annular cross-section defined between two imaginary concentric circles such that the wall thickness is substantially constant in all radial directions.
Figure 5:
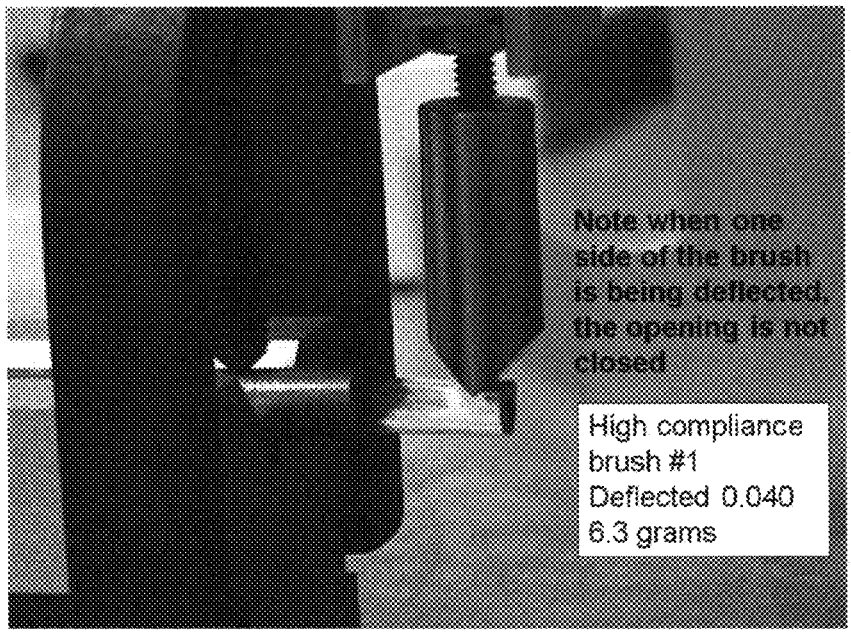
FIG. 5 is a photograph of a fixture for testing the compliance of a brush assembly, this view showing a normal force (i.e., a force substantially perpendicular to the longitudinal axis of the brush assembly) being exerted proximate the distal end of an improved brush assembly.

Improved FOT Brush with Center Removed (FIGS. 4-5)

The solution to the problem of material being transferred from the brush to the rotor by interfacial heating is one area of focus of the present application. At the same time that a solution to the adhesive wear problem has been found, an improved contact design has been developed that will reduce costs because non-noble materials can be used. Also, more compact brush and spring configurations have been developed that will require 4-5 times less space to package than with previous designs. Moreover, a wear life in excess of 5 billion inches [0.127 billion m] of ring travel has been demonstrated with only 0.025 inches [0.635 mm] of wear for a cantilever spring and 0.010 inches [0.254 mm] of wear for a negator spring. Neither case was to end-of-life. The negator spring could go another 5-10 billion inches of ring travel because brush force is not diminished as is the case with the cantilever.

In a circular FOT brush configuration, the highest interfacial temperature would be expected to be at the center of the brush. For that reason, the prior art FOT brush design was modified so that about fifty percent of the fibers were removed from the center. This resulted in an improved brush assembly having an annular transverse cross-section, when viewed in an axial direction form the end of the brush. See FIG. 4. In this form, the annulus was defined between two concentric imaginary circles. However, while preferred, this arrangement is not invariable. Other annular shapes and configurations might be employed. The improved brush assembly had the effect of reducing the frictional heating, and, at the same time, increasing the tangential compliance (i.e., the reciprocal of spring rate, or C=x/F, where C is the tangential compliance, x is the displacement, and F is the force that produced that displacement). When signal integrity is important, particularly at high surface speeds, high tangential brush compliance is essential to maintain electrical contact in locations where there is axial (pancake-type slip-ring) or radial (drum-type slip-ring) run out in the ring.

FIG. 5 illustrates the tangential compliance of this brush design and the equipment used to measure brush tangential compliance. Notice that the brush tube was placed in a fixture, and that a force F was applied toward the distal end of the brush to produce a displacement normal to the brush axis.

Figure 6:
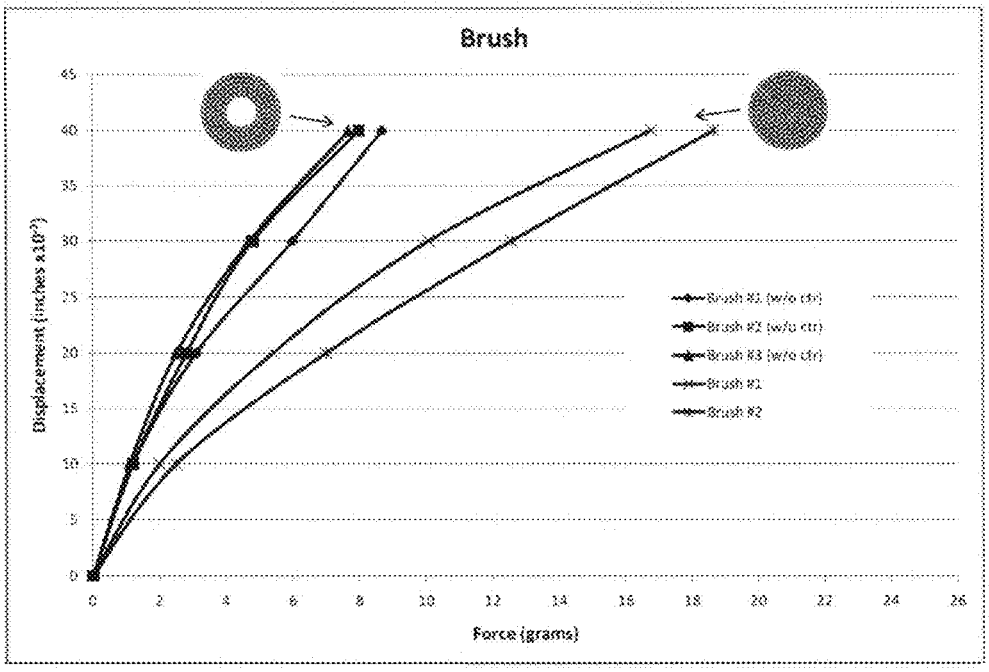
FIG. 6 is a plot of displacement (ordinate) vs. force (abscissa), and shows the compliance of an improved hollow brush assembly and the compliance of a prior art fully-packed (i.e., not hollowed) brush assembly.

A comparison of the tangential compliances of FOT brushes with and without the fibers in the center of the brush removed is shown in FIG. 6. Note that the tangential compliance of the improved FOT brush assembly is substantially greater than that of the prior art FOT brush assembly from which the central fibers had not been removed. The tangential compliance can be increased by reducing the fiber diameter, by increasing the free length of the fibers (i.e., the length of the fibers from the end of the tube to the tips of the fibers), and/or by increasing the diameter of the opening in the center of the brush assembly.

It has been shown in multiple tests that the interfacial contact area can reach a temperature such that the brush material is softening or melting and adhering to the ring. The ability to continuously apply a lubricant to the contact interface is crucial to reduce the coefficient of friction. Lubricant chemistry and formulation is a major factor to achieve long term electrical contact life. A variety of electrical contact lubricants have been tested. These include diesters, fluorocarbons, halocarbons, hydrocarbons, and polyphenyl ethers.

Figure 7:
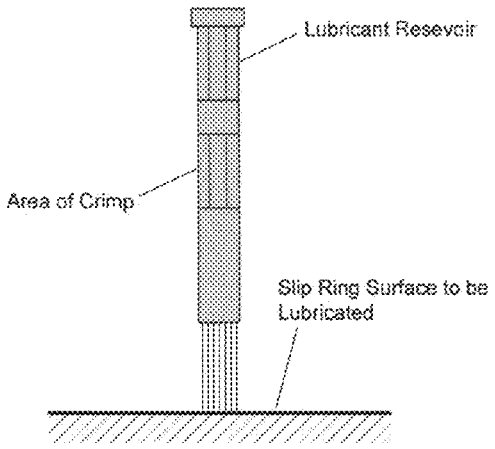
FIG. 7 is a schematic view of an improved brush assembly having a fluid lubricant reservoir operatively arranged to supply lubricant to the interstitial space between the fibers of an improved brush assembly.
Figure 8A:
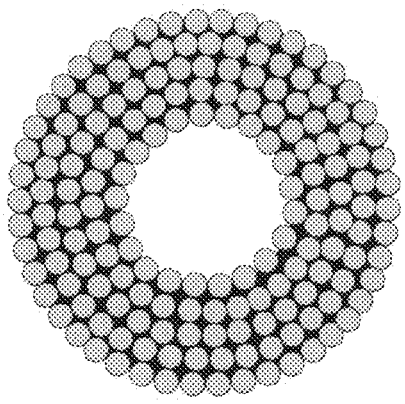
FIG. 8A is a schematic transverse end view of an improved fiber bundle having small-diameter fibers, and shows the number and size of the interstitial spaces between the fibers.
Figure 8B:
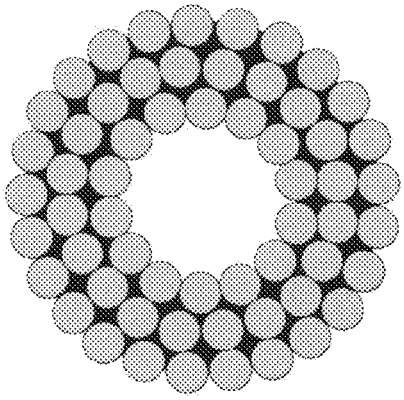
FIG. 8B is a schematic transverse sectional view of an improved fiber bundle having large-diameter fibers, and shows the number and size of the interstitial spaces between the fibers.

A chamber for lubricant was integrated into the brush tube which provides a continuous flow of lubricant into the interfacial area of contact (see FIG. 7). The flow of lubricant from the reservoir to the contact interface can be controlled by fiber diameter which determines the cross-sectional interstitial space between fibers, and, thus, the cross-sectional area for the lubricant to flow to the contact interface. Depending on the application, the diameter of the fiber can vary from 0.002-0.005 inches [0.0508-0.1270 mm]. See FIGS. 8A-8B. FIG. 8A shows the distal end of an improved FOT brush having a large number of small-diameter fibers. FIG. 8B shows the distal end of an improved FOT brush having a smaller number of large-diameter fibers. FIGS. 8A and 8B illustrate the interstitial space between the fibers increases with fiber diameter, but that the number of such interstitial spaces varies inversely with the fiber diameter.

A continuous flow of lubricant into the interfacial area of contact will also minimize oxidation in the interfacial area of contact and, thus, non-noble material can more readily be used. Alloys of silver and gold have been used as brush materials and silver or gold electrodeposited on copper or brass rings have been used extensively in past years. When an electrodeposit is used on the ring, the choice of fiber brush material must be compatible with the electrodeposited material otherwise premature wear may occur with both the brush and the electrodeposited material. It should be noted that when the electrodeposited material is worn such that the underlying ring is exposed, the ring and brushes will wear at a higher rate and end-of-life is near for both. If an electrodeposited material is not used on the ring, then the fiber material, the lubricant and the brush force must be such that good contact can be made during the life of the brush assembly. The lubricant can be selected and formulated on the basis of reducing the coefficient of friction as well as minimizing the degree of oxidation on the non-noble contact surface. Silver alloys, gold alloys, copper alloys (e.g., brass, beryllium copper, bronze, etc.) can be used for, fiber brushes, and ring materials can be fabricated from copper and copper alloys without a noble electrodeposit. These options provide a basis for significant cost reductions.

It has been shown that removing about fifty percent of the fibers from the center of a conventional FOT brush reduces frictional heating significantly and the adhesive wear referenced in FIGS. 1C-3I has been eliminated. Measurements on 9-inch [22.86 cm] diameter rotor running at a surface speed of 14.4 m/sec have shown that the current density capability of the improved FOT brush was significantly improved. This study was performed with a rotor that exhibits the "rpm effect" when run at 14.4 m/sec. When comparing frictional heating and electrical heating tests from one test platform to another, it is necessary to introduce another term to the previous equation (Id. at 31-32):

$$\theta = \frac{i^2 R}{4Jr(k_1 + k_2)}$$

where i is the current carried by the junction and R is the electric resistance.

Thus, when operating at high speed, the combined effect on temperature rise is given by the equation:

$$\theta = \frac{fLv + i^2 R}{3.6J(r^3 k_2 p_2 c_2 v)^{1/2}} = \frac{1}{3.6J(r^3 k_2 p_2 c_2)^{1/2}}\left(fLv^{1/2} + \frac{i^2 R}{v^{1/2}}\right)$$

When comparing brush temperature rise measurements from one test platform to another, it is necessary to take into consideration several ring parameters. Table 1 compares relevant parameters for the rotor used in the preliminary wear studies to test the improved brush with the corresponding parameters for a larger diameter rotor used to test the prior art brush.

TABLE 1

A Comparison of Rotor Properties Used for Testing Improved FOT and Prior Art Brushes

| | Rotor Properties | | | | | | |
|---|---|---|---|---|---|---|---|
| | Material | Diameter (m) | Volume ($m^3$) | Density ($kg/m^3$) | Mass (kg) | Volume Specific Heat (Kcal/kg ° C.) | Energy to Raise Rotor 1° C. (cal/° C.) |
| Improved FOT Brush | Brass | 0.23 | $4.3 \times 10^{-6}$ | 8520 | 0.037 | 0.090 | 3.3 |
| Prior Art FOT Brush | Copper | 1.02 | 0.19 | 8930 | 1.10 | 0.092 | 101 |

Figure 9C:
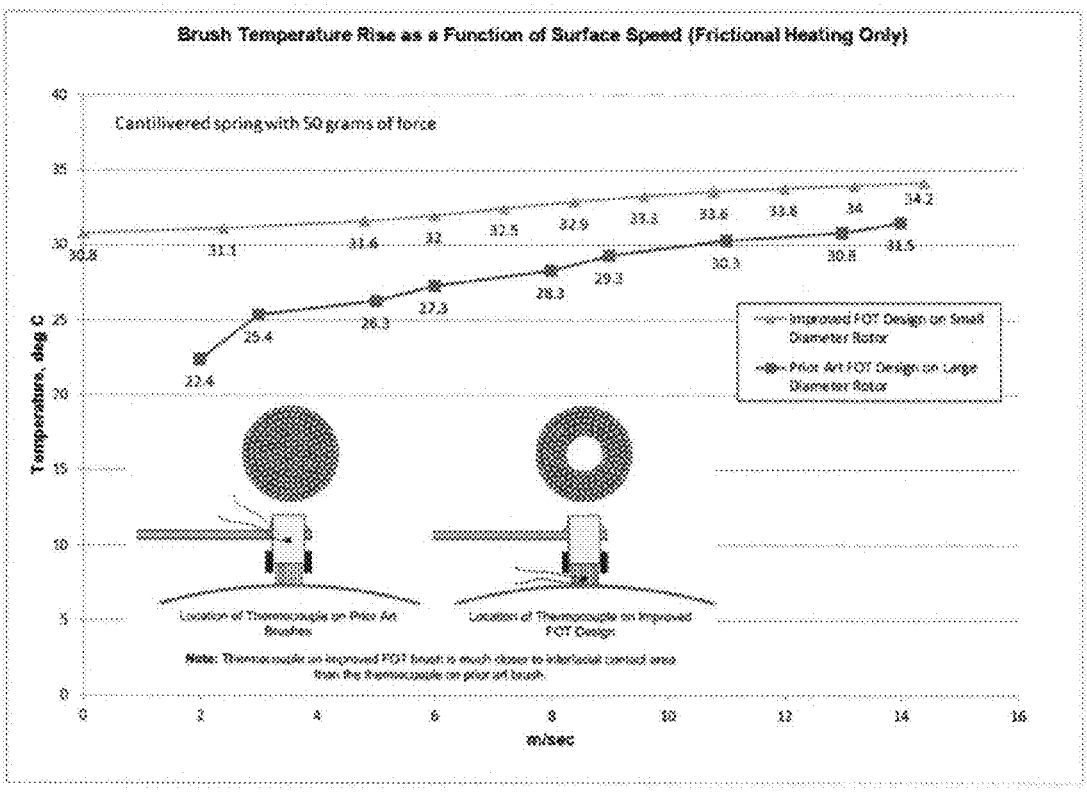
FIG. 9C is a plot of temperature (ordinate) vs. speed (abscissa) for an improved brush assembly and a prior art brush assembly loaded with 50 grams of force via a cantilevered spring vs. speed, and also showing thermocouple location.

In both cases the mass of the brush is small in comparison to the mass of the rotor and thus the brush when in continuous contact with the rotor will be hotter and, for that reason, heat will flow from the brush to the rotor. Thus, the thermal properties of the rotor are very important. Table 1 shows that the rotor used to test the improved FOT brush requires 3.3 calories to increase the rotor temperature 1 deg C., whereas the rotor used to test the prior art brush requires 101 calories to increase the rotor temperature 1 deg C. FIGS. 9A and 9B compare temperature rise for the improved FOT brush design vs. the prior art design at speeds up to 14 m/sec vs. increasing current. FIG. 9C compares the frictional heating for improved FOT design and prior art design brushes vs. surface speed. Table 2 is a comparison of frictional and electrical test results taken from FIGS. 9A, 9B, and 9C.

(Data for Table 2 is taken from FIGS. 9A, 9B, and 9C.)

TABLE 2

| Frictional and Electrical Test Results | | |
|---|---|---|
| **Frictional Heating** | | |
| | Improved FOT Brush Small Rotor | Prior Art FOT Brush Large Rotor |
| Current (amps) | 0 | 0 |
| Surface Speed (m/s) | 8 | 8 |
| ΔT (° C.) | 32.9 − 30.8 = 2.1 | 28.3 − 22.4 = 5.9 |
| Frictional Heating (cal.) | 2.1° C. × 3.3 cal/° C. = 6.93 | 5.9° C. × 101 cal/° C. = 596 |
| | Small Rotor | Large Rotor |
| Current (amps) | 0 | 0 |
| Surface Speed (m/s) | 14 | 14 |
| ΔT (° C.) | 34.2 − 30.8 = 3.4 | 31.5 − 22.4 = 9.1 |
| Frictional Heating (cal.) | 3.4° C. × 3.3 cal/° C. = 11.22 | 9.1° C. × 101 cal/° C. = 919 |
| **Electrical Heating** | | |
| | Improved FOT Brush Small Rotor | Prior Art FOT Brush Large Rotor |
| Current (amps) | 10 | 10 |
| Surface Speed (m/s) | 8 | 8 |
| ΔT (° C.) | 35.4 − 32.9 = 2.5 | 30.1 − 28.3 = 1.8 |
| Electrical Heating (cal.) | 2.5° C. × 3.3 cal/° C. = 8.25 | 1.8° C. × 101 cal/° C. = 181.8 |
| | Small Rotor | Large Rotor |
| Current (amps) | 20 | 20 |
| Surface Speed (m/s) | 14 | 14 |
| ΔT (° C.) | 44.3 − 34.2 = 10.1 | 33.5 − 31.5 = 2 |
| Electrical Heating (cal.) | 10.1° C. × 3.3 cal/° C. = 33.33 | 2° C. × 101 cal/° C. = 202 |

The improved FOT brush is generating significantly less frictional and electrical heat than the prior art brush based on these results, and, thus, the removal of 1000 fibers from the center of the brush has not diminished the performance of the brush, but has, in fact, greatly improved its performance. These results are in agreement with the prior art brush tests that indicated the interfacial temperature was high enough for the brush material to soften and transfer to the ring. (See paragraph [0083], supra.)

It is known that cantilever springs can be difficult to work with because of mechanical instabilities. [See, e.g., Shobert, Erle; *Carbon Brushes: The Physics and Chemistry of Sliding Contacts*; Chapter 4, FIG. 4.7, "Mechanical Considerations in Brushes and Collectors"; (1965); at p. 87.]

> "Chatter can take place on cantilever-spring brushes if the spring can vibrate in a way that relieves the spring force as the brush moves in one direction, and increases it in the other. * * * This chatter can be minimized by (1) keeping the brush as short as possible; (2) so designing the spring that it is practically straight when under load; and (3) tapering the spring, as shown in FIG. 4:7b. Tapering decreases the possibility that a natural period is available for resonant vibration."

Figure 9D:
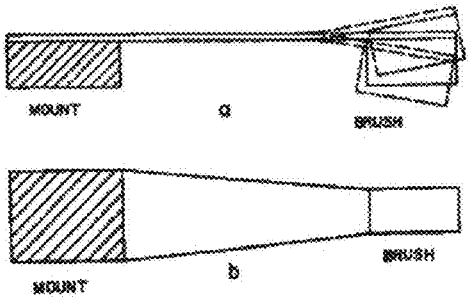
FIG. 9D is a schematic view showing the vibration of a cantilever spring, this being taken from the quoted text in the specification.

The referenced figures in the above text are reproduced herein as FIG. 9D.

In addition, a cantilever spring has the problem that the brush force (F) decreases with brush wear (x), and ultimately the life of the brush is limited by the minimum normal force that is required to meet all electrical requirements. If there is not adequate brush force, signal brushes will not operate at acceptable electrical noise levels and power brushes may undergo electrical arcing. This is a major factor for a brush that is capable of billions of inches of ring travel. The negator spring maintains a substantially-constant force over a given displacement range throughout the life of the brush and, therefore, the life of the brush is not limited by a decreasing force with brush wear. Also, the negator spring provides an inherent dampening mechanism and, therefore, brush spring "chatter" is eliminated.

FOT Brush with Negator Spring Designs

Figure 10:
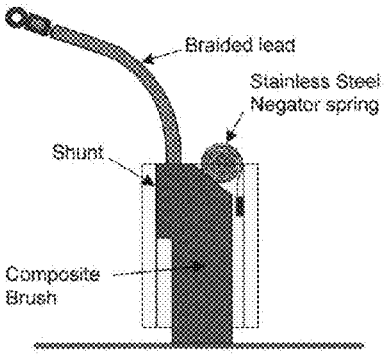
FIG. 10 is a schematic longitudinal sectional view showing a stainless steel negator spring arranged to urge a composite brush toward a rotor surface with substantially-constant force.
Figures 11A, 11B:
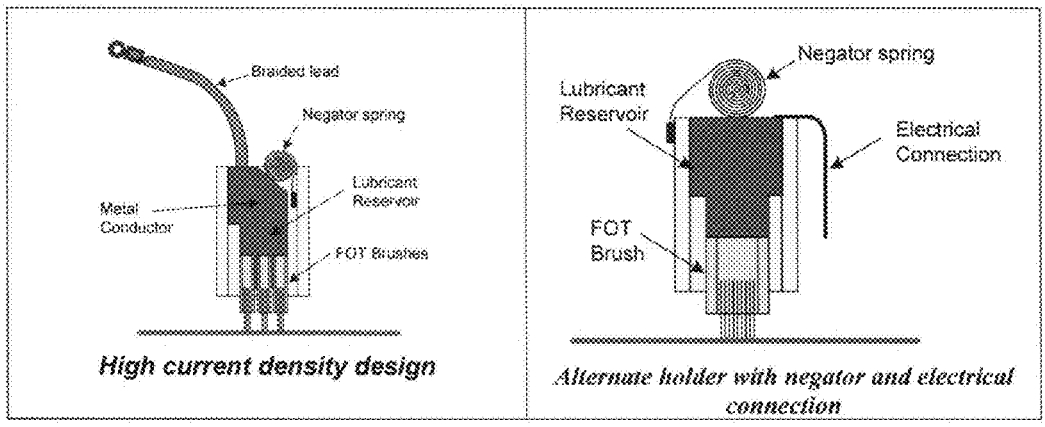
FIG. 11A is a schematic longitudinal sectional view of a high current density design of an improved brush assembly having a negator spring arranged to urge a plurality of lubricated FOT brush assemblies to move toward a rotor.
FIG. 11B is a schematic longitudinal sectional view of an alternate design to that shown in FIG. 11A, this design also having a negator spring arranged to urge an improved FOT brush assembly to move toward a rotor.
Figures 11C, 11D:
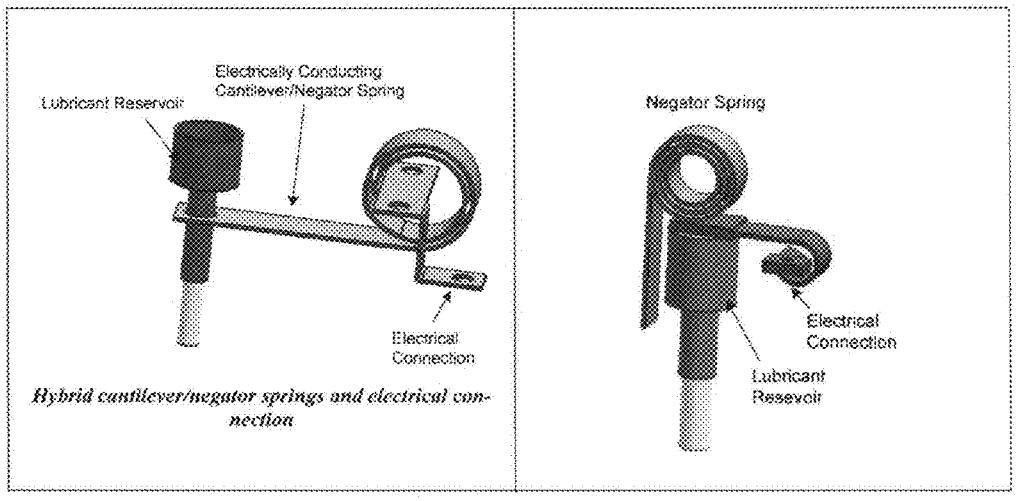
FIG. 11C is a schematic view of an alternative design having a hybrid cantilevered/negator spring arranged to urge a lubricated FOT brush assembly to move toward a rotor.
FIG. 11D is a schematic view of still another design having a negator spring arranged to urge a lubricated improved FOT brush assembly to move toward a rotor.
Figure 12:
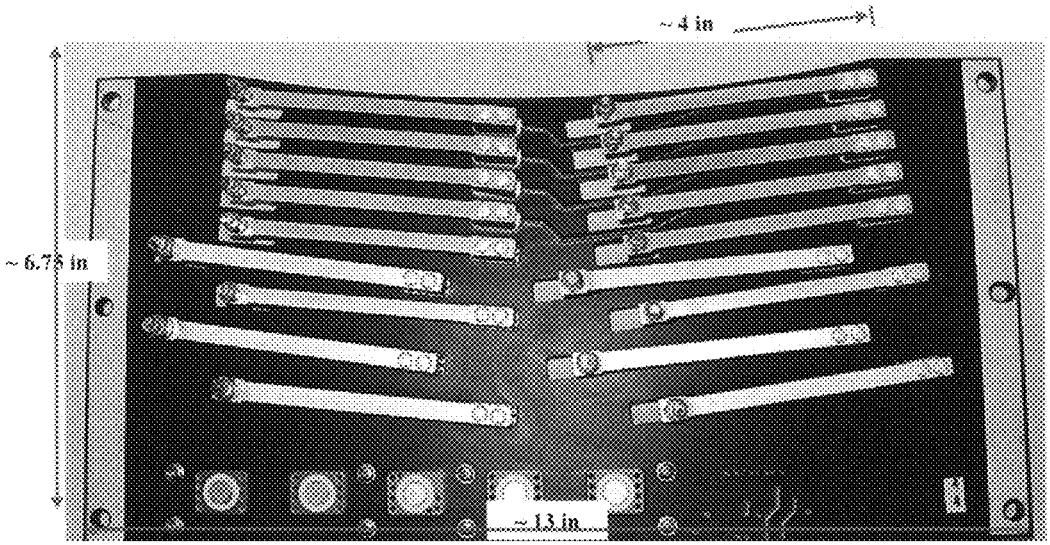
FIG. 12 is a photograph showing a plurality of prior art FOT brush assemblies mounted on a printed circuit board.

Normally, a negator spring is fabricated from a material, such as stainless steel which is not a good electrical conductor. For that reason, the electrical connection for a composite brush is made with a braided lead and a shunt. See FIG. 10. When a negator spring is used with a composite brush, the primary purpose of the negator spring is to provide a constant force over a broad range of brush displacement. If the composite brush wears as much as 0.20-0.30 inches [5.08-7.62 mm] (wear plus mechanical run-out), the normal force will remain constant. Multiple negator spring designs with FOT brushes are illustrated in FIGS. 11A-11D. FIG. 11A is a design that shows multiple FOT brushes in a common metal holder which can provide a means to make the electrical connection as well as being a lubricant reservoir. Each of these brushes is the same design as shown in FIG. 7. Multiple FOT brushes are provided for high current density requirements. FIG. 11B illustrates an alternate means of making the electrical connection and a lubricant reservoir. FIG. 11C is a hybrid design that has a cantilever spring and a negator spring, is electrically conductive and contains a lubricant reservoir. FIG. 11D is still another design for a device having a negator spring and a lubricant reservoir FOT Brush Circuit Board Designs FIG. 12 is a photograph of printed circuit board with multiple prior art FOT brushes mounted with cantilever springs. The width and length of the board shown is approximately 3.75×13 inches [9.525×33.02 cm].

Figure 13:
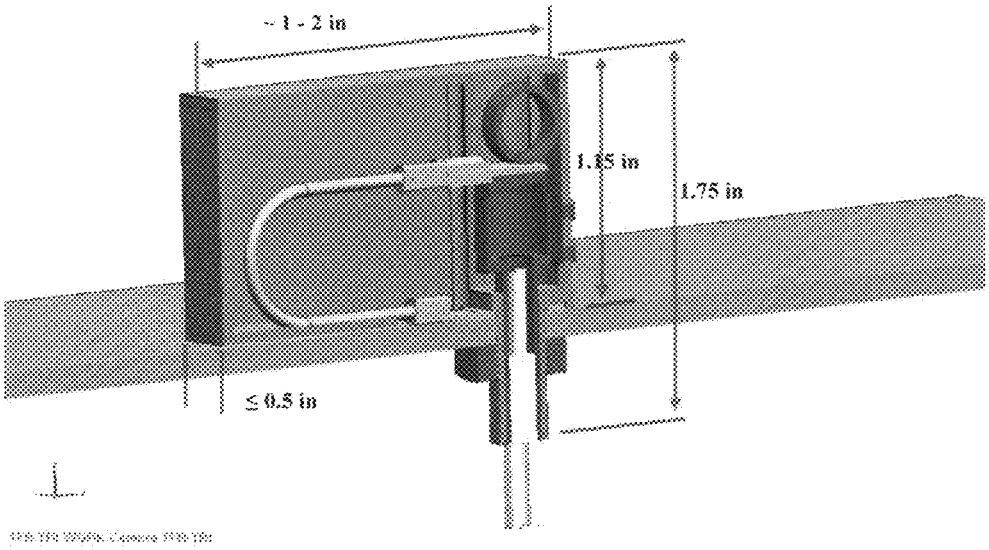
FIG. 13 is a schematic view showing a negator spring as being operatively arranged to urge a lubricated improved FOT brush assembly to move toward a rotor.

The printed circuit board for the negator spring design shown in FIG. 13 can be as much as 4-5 times smaller than is the case with a cantilever spring. This can be a major factor when space for packaging is limited.

Improved FOT Life Tests

Figure 14:
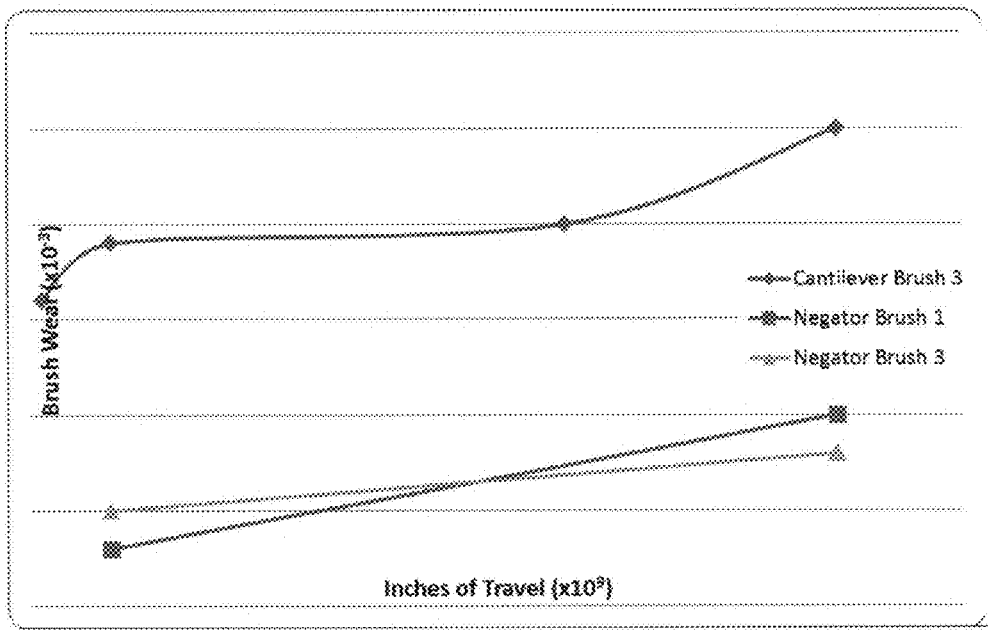
FIG. 14 is a plot of lubricated improved FOT brush wear (ordinate) vs. total inches of travel (abscissa) for a cantilever spring and for two different negator springs of the same design.

Long time life tests were performed with high tangential compliance FOT brushes to verify the performance of this brush design. Tests were performed with cantilever and negator springs. FIG. 14 and Table 3 are compilations of the data.

TABLE 3

Small Diameter Rotor Wear Study

| | Cantilever Spring | Negator Spring |
|---|---|---|
| Total Inches of Travel | $4.22 \times 10^9$ | $5.5 \times 10^9$ |
| Total Wear (Inches) | 0.025 | 0.010 |
| Dimensionless Wear Rate (Inches/Inch) | $5.92 \times 10^{-12}$ | $1.82 \times 10^{-12}$ |

Figure 15A:
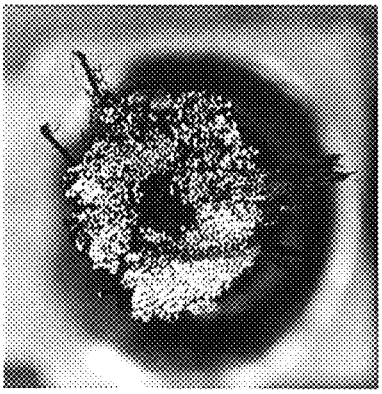
FIG. 15A is a photograph taken at a near-normal angle showing the wear pattern on a lubricated improved FOT brush after testing with a cantilevered spring.
Figure 15B:
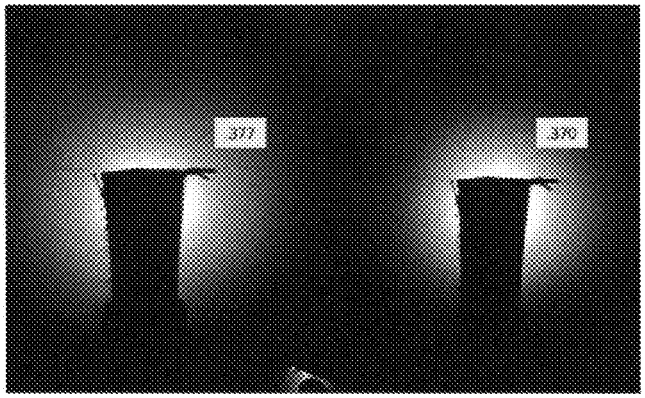
FIG. 15B is a composite photograph of the brush shown in FIG. 15A, showing the high and low points of the wear pattern thereon.
Figure 16A:
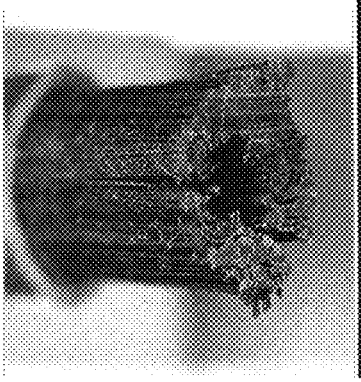
FIG. 16A is a photograph taken at an oblique angle showing the wear pattern of a lubricated improved FOT brush after testing with a negator spring.
Figure 16B:
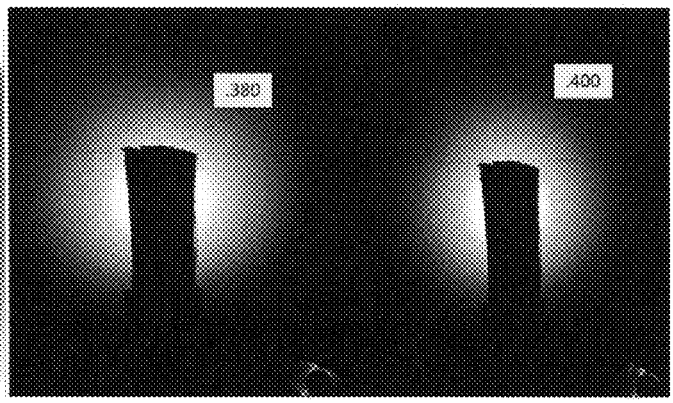
FIG. 16B is a composite photograph of the brush shown in FIG. 16A, showing the high and low points of the wear pattern thereon.

FIGS. 15A-15B and 16A-16B show the condition of the high compliance brush after $4.22\times10^9$ and $5.5\times10^9$ inches [$10.7188\times10^9$ and $13.97\times10^9$ cm] of ring travel for a cantilever spring and a negator spring, respectively. Note that after total amount of ring travel the brushes remain in extremely good shape; i.e., minimal total amount of wear and no indication of brush material being removed by an adhesive wear mechanism. FIGS. 15B and 16B are side elevations of the brushes shown in FIGS. 15A and 16A, respectively. It should be noted that, based on the condition of the brushes tested with negator springs, these tests could be extended another 5-10 billion inches [12.7-25.4 billion cm]. The primary reasons this would be possible are because of the ability to continuously provide lubrication to the interfacial contact area and the ability of the negator spring to provide dampening of the brush as well as a constant force throughout life.

Improved FOT brush design parameters can be combined to satisfy a broad range of brush and slip-ring requirements for various military and commercial applications, such as solar array drive mechanisms, aircraft and missile guidance platforms, wind energy systems, computed tomography (CT scan) systems, and the like. The design parameters, and the effects(s) thereof, of the improved FOT brush design(s) are summarized in Table 4:

TABLE 4

| Improved FOT Brush Design Parameter | Effect of Parameter on Slip-Ring Design and Performance |
|---|---|
| Removal of Center of Brush | Contact interfacial temperature is reduced, and, thus, brush life is greatly improved |
| | Allows brush compliance to be varied |
| Brush Free Length Adjustment | Allows brush compliance to be varied |
| Variation of Brush Fiber Diameter | Allows brush compliance to be varied |
| | Allows flow rate of lubricant to contact interfacial area to be varied |
| Lubrication Reservoir | Allows lubricant to be provided throughout brush life, and, thus, increases brush life |
| Lubrication Chemistry | A variety of lubricants and additives are available to meet the conditions of long brush life under extreme conditions of surface speed and temperature |
| Negator Spring | Allows a constant force throughout brush life |
| | Dampens contact vibration and keeps brush from breaking electrical contact with ring |
| Cantilever Spring | Allows brush spring compliance to be adjusted |
| The Combination of all Parameters Listed Above | Allows improved FOT brush technology to be used in a broad range of applications under extreme conditions with a broad range of brush and ring materials including silver alloys, gold alloys and copper alloys (e.g., brass, beryllium copper, bronze, etc.) |

Modifications

The present invention contemplates that many changes and modifications may be made.

For example, the annulus may be formed between two concentric circles. Alternatively, the annulus may be formed between other geometric shapes and configurations. The brush material may be changed, as desired. The lubricant may be of the type described, or some other lubricant may be used. The lubricant may be a diester, fluorocarbon, halorcarbon, hydrocarbon, polyphenyl ether, or may be some other type. The lubricant reservoir may have multiple configurations for receiving brushes and for storing and dispensing lubricant. The lubricant reservoir allows for a number of different electrical connections. See, e.g., FIGS. 10-11D for some (but not all) different electrical connections. The volume or capacity of the lubricant reservoir may be changed or varied. The reservoir may be refilled with lubricant from time-to-time, as desired.

As noted above, silver alloys, gold alloys and copper alloys (e.g., brass, beryllium copper, bronze, etc.) may be used for the fiber brushes. Other types of materials may be used. Similarly, while the ring materials may be fabricated from copper and copper alloys, other ring materials may also be used.

A unique feature of the improved slip-ring lies in the ability to operate without an electrodeposit on the rings if lubricant is provided on a continuous basis to the interfacial contact area.

Negator springs provide the capability of providing a wide range of brush forces, of providing a constant force throughout the life of the brush assembly, and of damping brush vibrations.

Therefore, while the present invention provides an improved electrical contact for slip-rings, and several modifications have been discussed, persons skilled in this art will readily appreciate that various additional changes and modifications may be made without departing from the spirit of the invention, as defined and differentiated in the following claims.

The invention claimed is:

1. In a slip-ring for providing electrical contact between a stator and a rotor, said slip-ring including a brush assembly having a brush tube mounted on one of said rotor and stator and having a fiber bundle composed of a number of individual fibers, one marginal end portion of said fibers being received in said brush tube, other marginal end portion of said fibers extending beyond said brush tube toward the other of said rotor and stator, an improvement comprising:

a central portion of said fibers having been removed below said brush tube such that the fibers extending below said brush tube toward said other of said rotor and stator are in a form of an annulus; and wherein a tangential compliance of said fiber bundle at its point of contact with said rotor is more than twice a tangential compliance of said fiber bundle if said central portion had not been removed.

2. The improvement as set forth in claim 1 wherein the tangential compliance of said fiber bundle may be varied as a function of diameters of said fibers, a free length of said fibers from the end of said brush tube toward tips of said fibers, and an area of said central portion.

3. The improvement as set forth in claim 1 wherein a portion of said brush tube is crimped or swaged to hold said one marginal end portion of said fibers therein.

4. The improvement as set forth in claim 1 wherein the tangential compliance of the fiber bundle at its point of contact with said rotor is more than 2½ times the tangential compliance of said fiber bundle if said central portion had not been removed.

5. The improvement as set forth in claim 1 wherein said fiber bundle has about 2000 individual fibers.

6. The improvement as set forth in claim 5 wherein said central portion includes about 1000 fibers.

7. The improvement as set forth in claim 1 wherein said central portion contains about half of a number of fibers in said fiber bundle.

8. The improvement as set forth in claim 1 wherein said annulus has a substantially-constant radial thickness.

9. The improvement as set forth in claim 1 wherein said fibers have diameters in the range of 0.002-0.005 inches.

10. The improvement as set forth in claim 9 wherein each fiber has a diameter of about 0.003 inches.

11. The improvement as set forth in claim 1 wherein a length of said fibers extending beyond said tube and toward said rotor is in the range of 0.3-0.7 inches.

12. The improvement as set forth in claim 11 wherein the length of said fibers extending beyond said tube and toward said rotor is about 0.40 inches.

13. The improvement as set forth in claim 1 wherein a transverse cross-sectional area of said central portion is more than ⅔ of the transverse cross-sectional area of said fiber bundle.

14. The improvement as set forth in claim 1 wherein the tangential compliance of said fiber bundle at its point of contact with said rotor is about 0.006350 inches/gram.

15. The improvement as set forth in claim 14 wherein the tangential compliance of a fiber bundle from which said central portion had not been removed at its point of contact with said rotor is about 0.00139 inches/gram.

16. The improvement as set forth in claim 1 wherein the tangential compliance of the fiber bundle at its point of contact with said rotor is more than 4.5 times the tangential compliance of said fiber bundle at its point of contact with said rotor if said central portion had not been removed.

17. The improvement as set forth in claim 1, and further comprising: a reservoir above said brush tube, said reservoir being in fluid communication with said fiber bundle; and a lubricant in said reservoir.

18. The improvement as set forth in claim 17 wherein said lubricant includes at least one of a diester, a fluorocarbon, a halocarbon, a hydrocarbon, and a polyphenyl ester.

19. The improvement as set forth in claim 17 wherein said reservoir is in fluid communication with said fiber bundle through the spaces between said fibers.

20. The improvement as set forth in claim 19 wherein the flow of lubricant through said spaces is a function of the sizes of said spaces.

21. The improvement as set forth in claim 1, and further comprising: resilient means for urging said fiber bundle to move toward said rotor.

22. The improvement as set forth in claim 21 wherein said fiber bundle is urged to move toward said rotor with substantially-constant force.

23. The improvement as set forth in claim 21 wherein said resilient means includes a negator spring.

24. The improvement as set forth in claim 21 wherein said resilient means includes a cantilever spring.

25. The improvement as set forth in claim 1 wherein said other of said rotor and stator does not have an electrodeposited material.

26. The improvement as set forth in claim 1 wherein said fibers are formed of at least one of a silver alloy, a gold alloy and a copper alloy.

* * * * *